US005286226A

United States Patent [19]

Rasmussen

[11] Patent Number: 5,286,226

[45] Date of Patent: Feb. 15, 1994

[54] DISC-TYPE COIN SORTER

[75] Inventor: James M. Rasmussen, Chicago, Ill.

[73] Assignee: Cummins-Allison Corporation, Mt. Prospect, Ill.

[21] Appl. No.: 942,353

[22] Filed: Sep. 9, 1992

Related U.S. Application Data

[63] Continuation of Ser. No. 709,108, Jun. 3, 1991, abandoned.

[51] Int. Cl.[5] ..... G07D 3/02

[52] U.S. Cl. ..... 453/10

[58] Field of Search ..... 453/6, 10, 32, 57

[56] References Cited

U.S. PATENT DOCUMENTS

| | | | |
|---|---|---|---|
| 4,086,928 | 5/1978 | Ristvedt . | |
| 4,098,280 | 6/1978 | Ristvedt . | |
| 4,506,685 | 3/1985 | Childers et al. . | |
| 4,543,969 | 10/1985 | Rasmussen | 453/10 |
| 4,549,561 | 10/1985 | Johnson et al. | 453/10 |
| 4,557,282 | 12/1985 | Childers et al. . | |
| 4,564,036 | 1/1986 | Ristvedt . | |
| 4,564,037 | 1/1986 | Childers et al. . | |
| 4,570,655 | 2/1986 | Raterman | 453/32 X |
| 4,607,649 | 8/1986 | Taiple et al. . | |
| 4,681,128 | 7/1987 | Ristvedt et al. . | |
| 4,731,043 | 3/1988 | Ristvedt | 453/6 |
| 4,775,353 | 10/1988 | Childers et al. . | |
| 4,775,354 | 10/1988 | Rasmussen | 453/10 |
| 4,863,414 | 9/1989 | Ristvedt et al. . | |
| 4,921,463 | 5/1990 | Primdahl et al. . | |
| 4,966,570 | 10/1990 | Ristvedt et al. | 453/6 |
| 5,009,627 | 4/1991 | Rasmussen | 453/10 |
| 5,011,455 | 4/1991 | Rasmussen | 453/10 |
| 5,026,320 | 6/1991 | Rasmussen . | |
| 5,106,338 | 4/1992 | Rasmussen et al. | 453/10 |

*Primary Examiner*—F. J. Bartuska
*Attorney, Agent, or Firm*—Arnold, White & Durkee

[57] ABSTRACT

A coin sorter have a rotatable disc means for rotating the disc, a stationary sorting head having a feed opening for receiving coins to be sorted, and a lower surface parallel to the upper surface of the rotatable disc and spaced slightly therefrom, the lower surface of the sorting head forming an annular recess for receiving coins passing beneath the inner edge of the sorting head, a spiral channel for guiding those coins radially outwardly as the coins are carried along the lower surface of the sorting head by the rotating disc, the lowermost surface of the sorting head forming a region between the inlet end of the spiral channel and the annular recess so that coins traversing the region are pressed into the resilient pad, the lower surface of the sorting head also forming a ramp where the outermost wall of the annular recess meets the region for pressing coins whose outer edges are close to the outer wall into the resilient pad, the outer wall of the annular recess extending radially inwardly from the inner edge of the ramp for recirculating coins which do not engage the ramp.

2 Claims, 6 Drawing Sheets

DISC-TYPE COIN SORTER

This is a continuation of copending application(s) Ser. No. 07/709,108 filed on Jun. 3, 1991 now abandoned.

FIELD OF THE INVENTION

The present invention relates generally to coin sorting devices and, more particularly, to coin sorters of the type which use a resilient disc rotating beneath a stationary sorting head for sorting coins of mixed denominations.

SUMMARY OF THE INVENTION

It is a primary object of the present invention to provide an improved coin sorter which is capable of processing a wide variety of different coin sizes, e.g., the coin sets of different countries, without any significant changes in accuracy of throughput rate.

Another related object of the invention is to provide such an improved coin sorter which facilitates the alignment of coins of mixed denominations in a single layer and in single file, particularly when the set of coins being sorted includes a wide variety of different coin sizes.

A further object of this invention is to provide an improved coin sorter which improves the sorting accuracy for certain types of coin sets.

Other objects and advantages of the invention will be apparent from the following detailed description and the accompanying drawings.

In accordance with the present invention, the foregoing objectives are realized by providing a coin sorter comprising a rotatable disc, a drive motor for rotating the disc, a stationary sorting head having a feed opening for receiving coins to be sorted and a lower surface parallel to the upper surface of the rotatable disc and spaced slightly therefrom, the lower surface of the sorting head forming an annular recess for receiving coins passing beneath the inner edge of the sorting head, and a spiral channel for receiving coins carried along the lower surface of the sorting head and guiding those coins outwardly away from the center of rotation of the disc, as the coins are carried along the lower surface of the sorting head by the rotating disc, a ramp for engaging coins whose outer edges are close to the outer wall of the annular recess and pressing the coins down into the resilient pad so that the coins are carried by the pad along a portion of the lowermost surface of the sorting head, at a constant radius from the center of rotation of the disc, to the inlet of the spiral channel, and an inwardly spirally wall forming the inner edge of the ramp and extending inwardly from the ramp to the inner periphery of the sorting head for guiding coins which are not engaged by said ramp back into the feed opening of said sorting head.

In a preferred embodiment, the sorting head also includes a gaging channel for receiving coins from the spiral channel for accurately positioning the radial positions of the coins for sorting, the gaging channel having a relatively shallow region at the inlet end thereof for stabilizing vertical movement of coins entering said gaging channel, and a relatively deep region for permitting coins of all thicknesses to move radially outwardly into engagement with the outer wall of the gaging channel.

DESCRIPTION OF THE PREFERRED EMBODIMENTS

Figure 1:
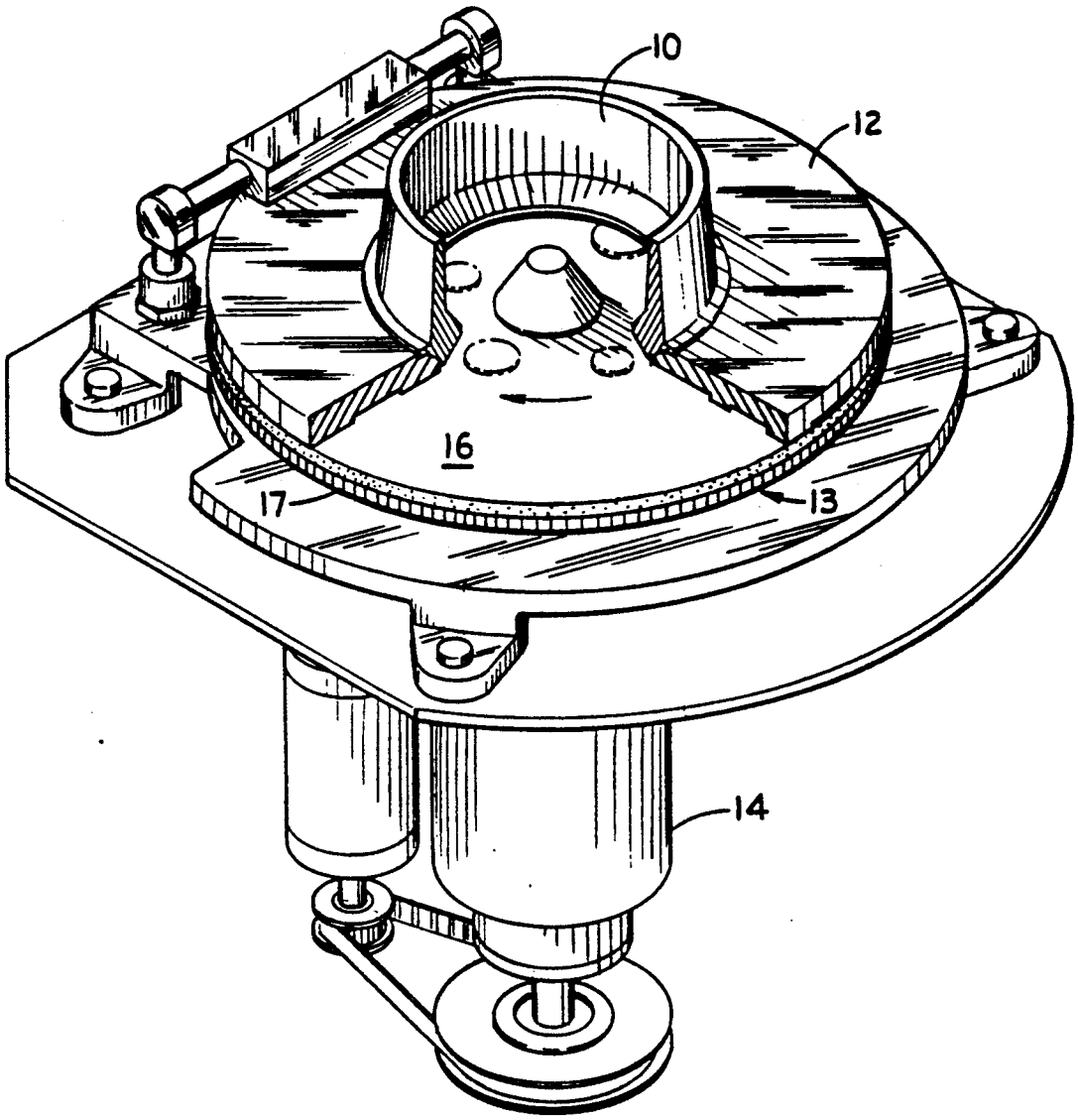
FIG. 1 is perspective view of a coin sorter embodying the present invention, with portions thereof broken away to show the internal structure.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Turning now to the drawings and referring first to FIG. 1, a hopper 10 receives coins of mixed denominations and feeds them through a central feed aperture in an annular sorting head or guide plate 12. As the coins pass through the feed aperture, they are deposited on the top surface of a rotatable disc 13. This disc 13 is mounted for rotation on a stub shaft (not shown) and driven by an electric motor 14. The disc 13 comprises a resilient pad 16, preferably made of a resilient rubber or polymeric material, bonded to the top surface of a solid metal disc 17.

As the disc 13 is rotated, the coins deposited on the top surface thereof tend to slide outwardly over the surface of the pad 16 due to centrifugal force. As the coins move outwardly, those coins which are lying flat on the pad 16 enter the gap between the pad surface and the sorting head 12 because the underside of the inner periphery of the sorting head is spaced above the pad 16 by a distance which is about the same as the thickness of the thickest coin.

Figure 2:
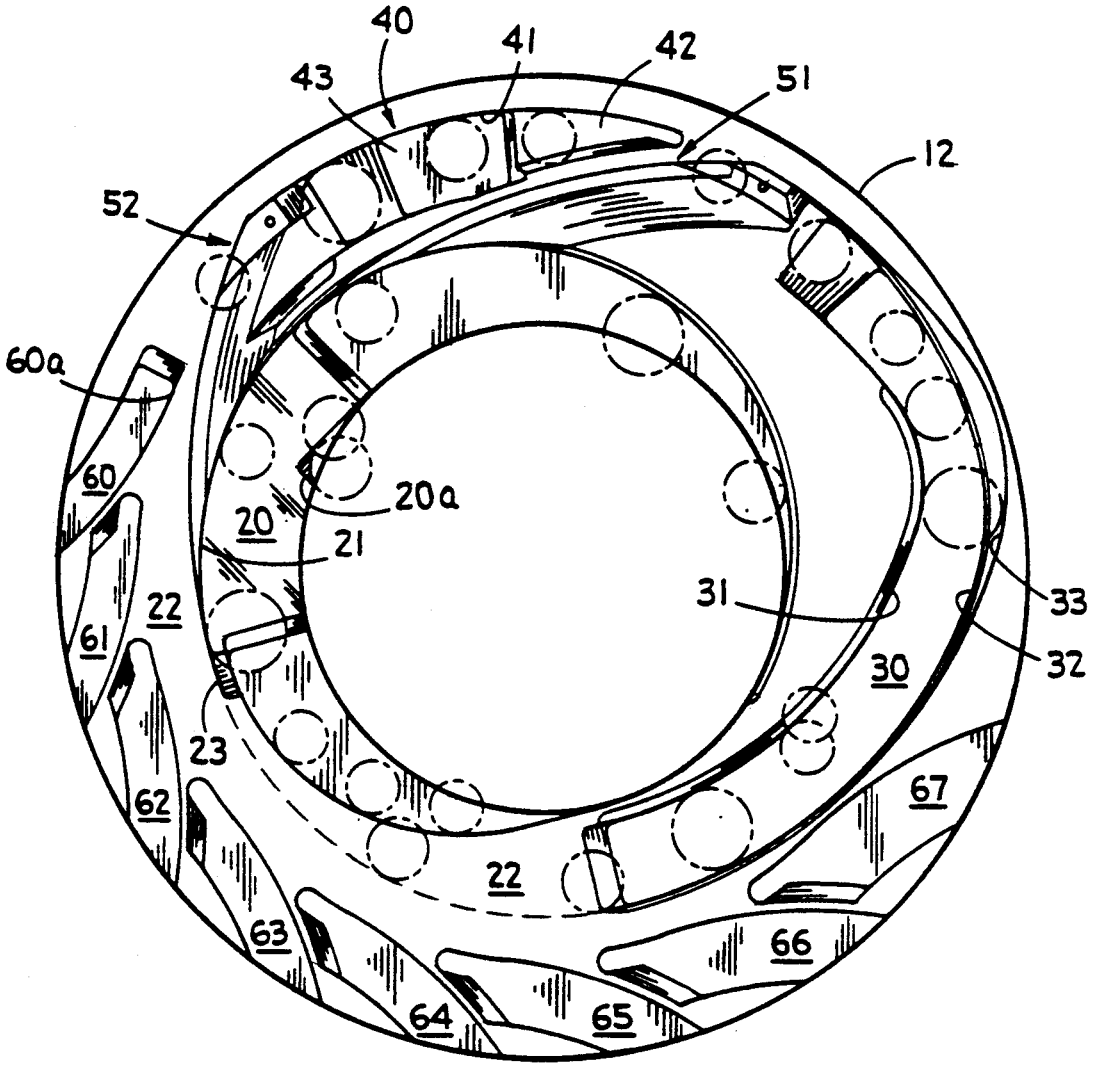
FIG. 2 is an enlarged bottom plan view of the sorting head or guide plate in the coin sorter of FIG. 1.
Figure 3:
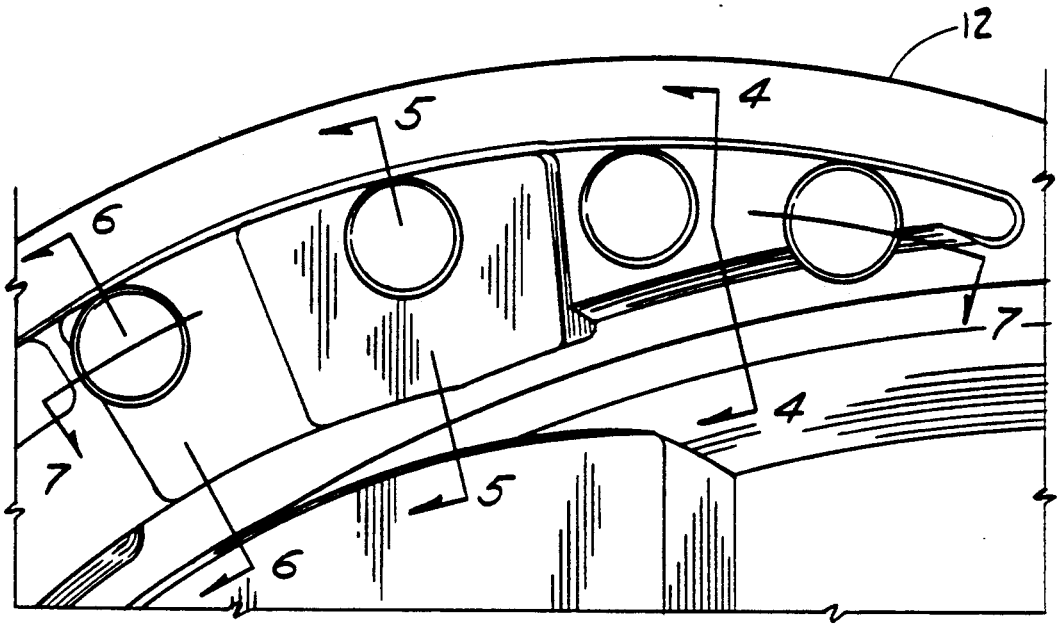
FIG. 3 is an enlarged view of the upper portion of FIG. 2, with various coins superimposed thereon.
Figure 4:
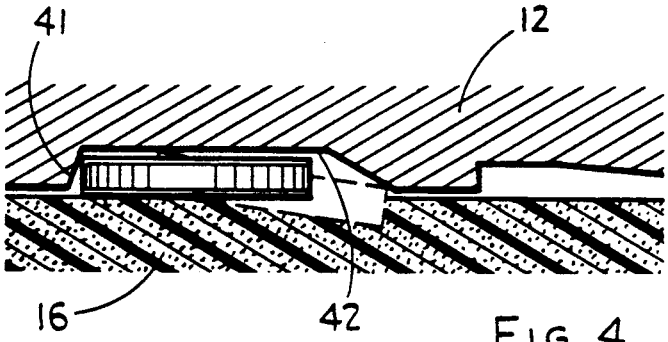
FIG. 4 is an enlarged section taken generally along fine 4—4 in FIG. 2, showing the coins in full elevation.
Figure 5:
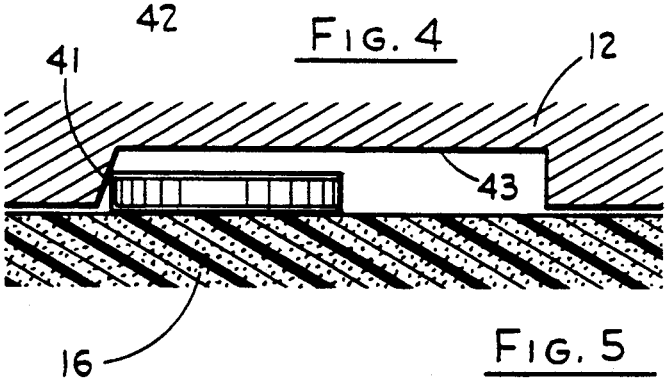
FIG. 5 is an enlarged section taken generally along line 5—5 in FIG. 2, showing the coins in full elevation.
Figure 6:
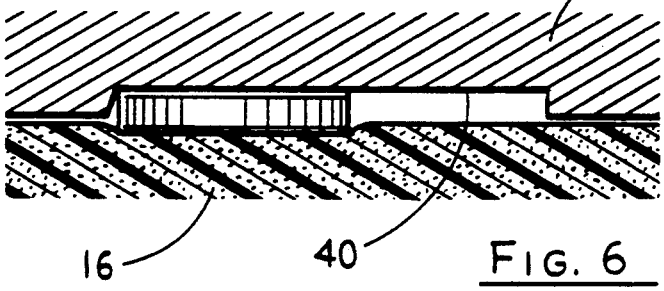
FIG. 6 is an enlarged section taken generally along line 6—6 in FIG. 2, showing the coins in full elevation.
Figure 7:
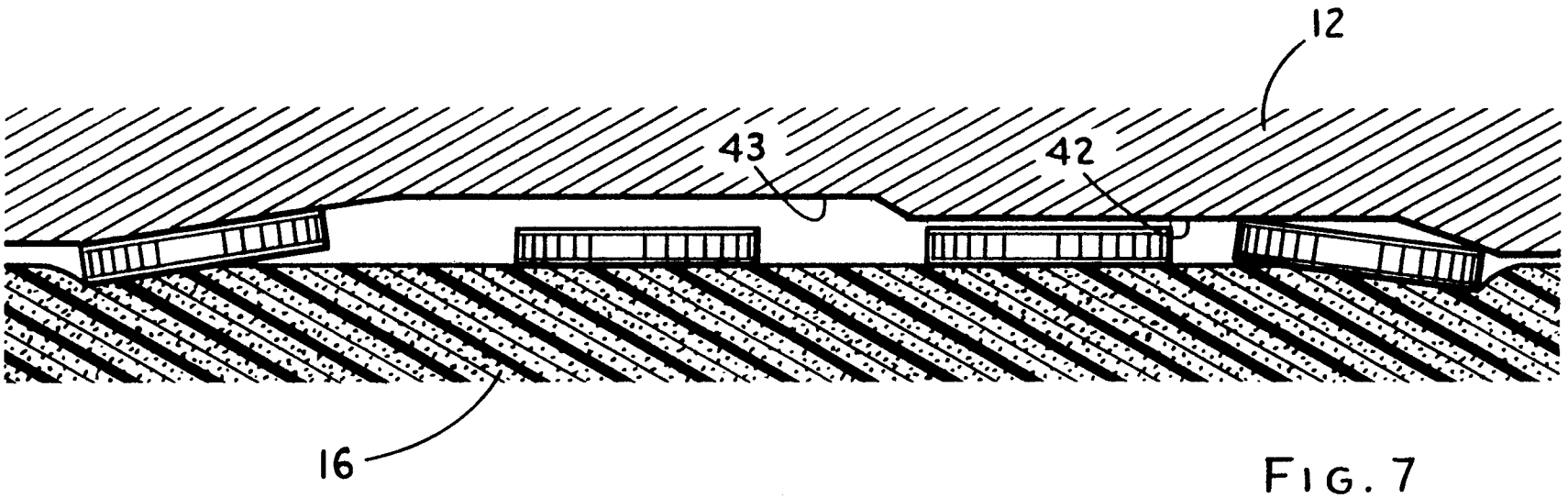
FIG. 7 is an enlarged section taken generally along line 7—7 in FIG. 2, showing the coins in full elevation.
Figure 8:
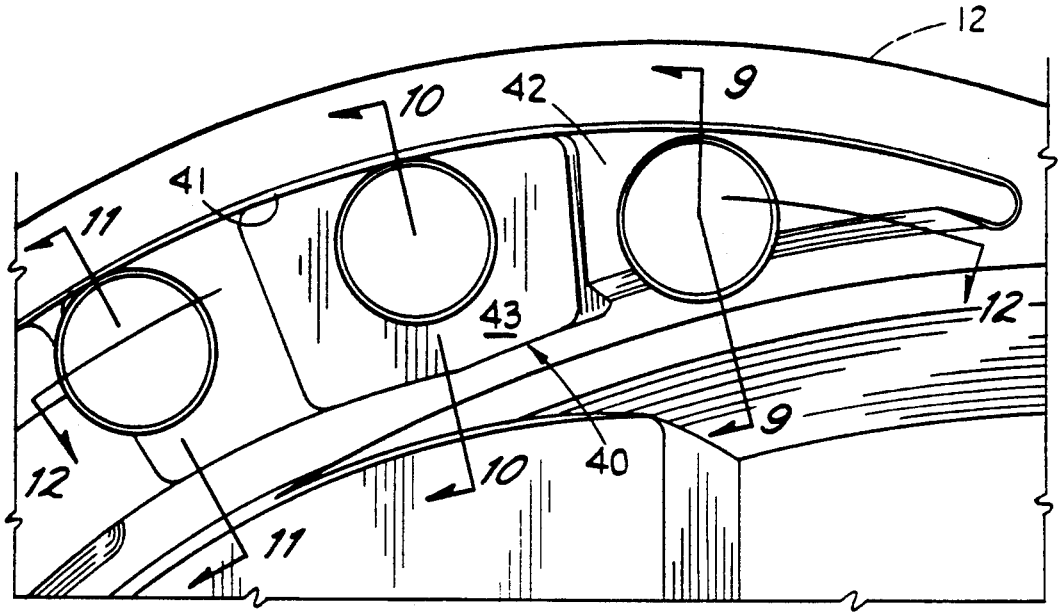
FIG. 8 is the same view shown in FIG. 3, but with different coins superimposed thereon.
Figure 9:
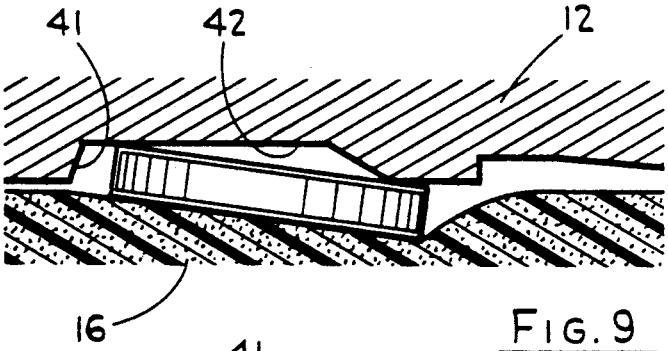
FIG. 9 is an enlarged section taken generally along line 9—9 in FIG. 8, showing the coins in full elevation.
Figure 10:
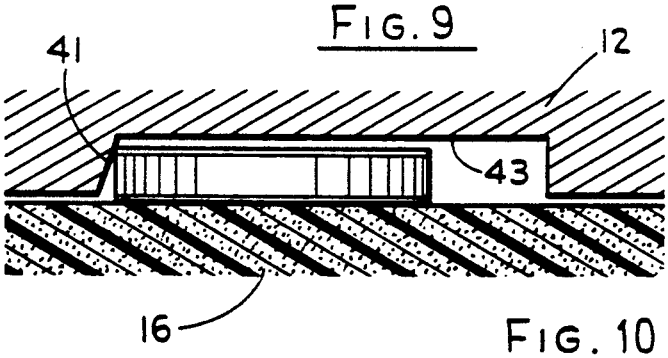
FIG. 10 is an enlarged section taken generally along line 10—10 in FIG. 8, showing the coins in full elevation.
Figure 11:
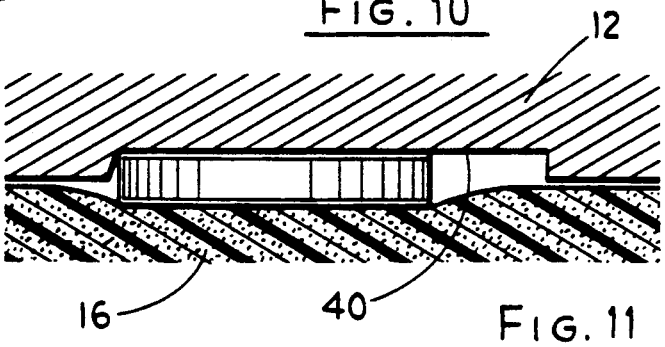
FIG. 11 is an enlarged section taken generally along line 11—11 in FIG. 8, showing the coins in full elevation.
Figure 12:
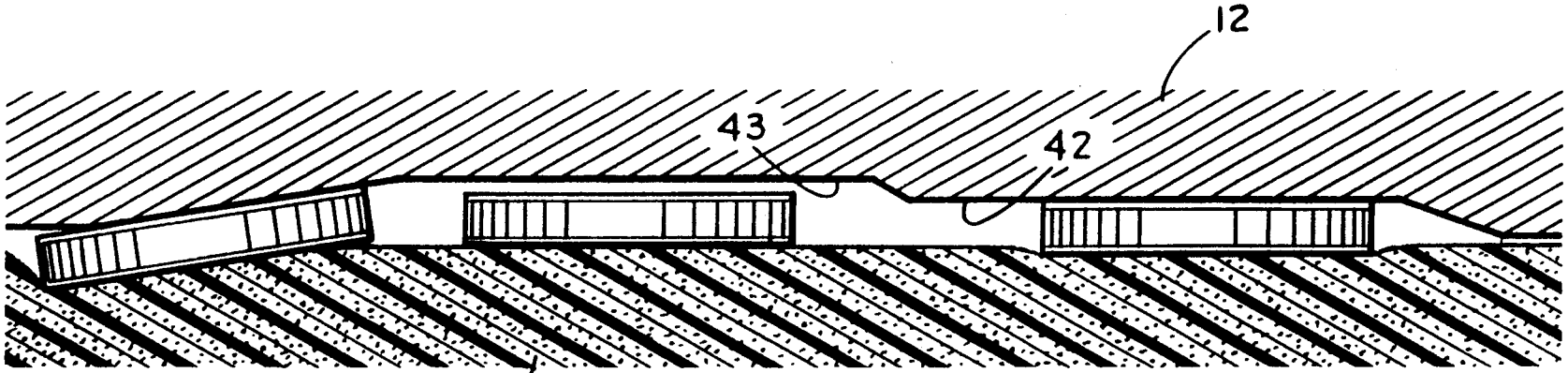
FIG. 12 is an enlarged section taken generally along line 12—12 in FIG. 8, showing the coins in full elevation.

As can be seen most clearly in FIG. 2, the outwardly moving coins initially enter an annular recess 20 formed in the underside of the sorting head 12 and extending around a major portion of the inner periphery of the sorting head. The outer wall 21 of the recess 20 extends downwardly to the lowermost surface 22 of the sorting head, which is preferably spaced from the top surface of the pad 16 by a distance e.g., 0.010 inch, which is slightly less, e.g., 0.010 inch, than the thickness of the thinnest coin. Consequently, the initial radial movement of the coins is terminated when they engage the wall 21 of the recess 20, though the coins continue to move circumferentially along the wall 21 by the rotational movement of the pad 16. Overlapping coins which only partially enter the recess 20 are stripped apart by a notch 20a formed in the top surface of the recess 20 along its inner edge (see FIG. 2).

In accordance with one aspect of the present invention, a narrow ramp 23 forms a transition between the annular recess 20 which receives coins from the feed opening in the sorting head, and the lowermost surface of the sorting head, so that coins positioned close to the outer wall 21 of the annular recess 20 are pressed into the resilient pad 16 and carried concentrically to the inlet of a spiral channel 30, while coins positioned inwardly of the ramp 23 are guided back to the feed opening of the sorting head by an inwardly spiraling portion 21a of the wall 21. Coins which engage the ramp 23 are pressed into the pad 16 and carried at a fixed radius until they enter the spiral channel 30 which guides the coins to a gaging channel 40. Recycling channels 51 and 52 are provided at the outlets of the channels 30 and 40, respectively, for recycling coins which do not have their outer edges close to the outer walls of the respective channels.

Because the only coins that reach the spiral channel are those coins which are close enough to the wall 21 to engage the ramp 23, the coins enter the spiral channel in an organized fashion. For example, only a single row of coins can enter the spiral channel, which greatly reduces or even eliminates the possibility of double rows of coins within the spiral channel. Consequently, stacked or shingled coins which enter the spiral channel can easily reach the inner wall of that channel, which is the wall that separates stacked or shingled coins.

A further advantage of the illustrative arrangement is that the number of coins which ride under the lower most surface of the sorting head in the region inboard of the spiral channel is reduced. Reducing the flow of coins in this region is advantageous because it reduces the load on the drive motor for the disk, and also reduces wear on the sorting head and the coins.

The spiral channel 30 causes coins of different thicknesses and/or diameters to follow different paths which facilitate the queuing of the coins and increase the coin throughput rate. Though following different paths, the coins of all denominations exit the spiral channel 30 with a common edge (the outer edges of all coins) aligned at the same or approximately the same radial position so that the opposite (inner) edges of the coins can be used for sorting.

The spiral channel 30 includes an inner channel region defined by an inner wall 31 and a middle wall 32, and an outer channel region defined by the middle wall 32 and an outer wall 33. The inner channel region is deeper than the outer channel region, and the middle wall 32 is tapered to enable coins to pass under that wall under certain conditions to be described below. Coins of different thicknesses and/or diameters follow different paths within one or both of the channel regions.

Coins which have a diameter smaller than the width of the channel region between the inner wall 31 and the middle wall 32 of the channel, and which are thin enough to avoid being pressed into the resilient pad, are guided through the channel by the middle wall 32. These coins exit from the channel 30 with their outer edges at the desired gaging radius $R_g$. Because the outer region of the channel, between the middle wall 32 and the outer wall 33, is spaced from the resilient pad by a distance that is less than the thickness of the thinnest coin, the only coins that pass outwardly over the middle wall 32 are those that are wider than the radial distance between the inner and middle walls; such coins are forced over the middle wall 32 by the inner wall 31 of the channel. Coins guided by either the middle wall 32 or the outer wall 33 have their outer edges aligned at the same gaging radius $R_g$ because the middle and outer walls merge at the end of the spiral channel 30.

The illustrative spiral channel 30 also strips apart stacked or shingled coins, as illustrated in FIG. 2. In general, the combined thickness of a pair of stacked or shingled coin is great enough to cause the lower coin in that pair to be pressed into the resilient pad. Consequently, that pair of coins will be rotated concentrically with the disc. Because the inner wall 31 spirals outwardly, the upper coin will eventually engage the upper vertical portion of the inner wall 31, and the lower coin will engage the tapered lower portion of the inner wall, and pass under that wall. The latter coin will be recirculated back to the entry region of the sorting head and will later re-enter the spiral channel.

A different path is followed by coins which have a diameter small enough to enable them to enter and remain between the middle and outer walls 31 and 32 throughout the entire length of the spiral channel 30, and which have a thickness greater than the distance between the channel ceiling and the resilient pad. These coins are pressed into the resilient pad and, consequently, move concentrically with the disc until they engage the inner wall 31. They are then guided by the inner wall 31 until the radius of the inner wall 31 begins to decrease.

As the inner wall 31 drops away from the advancing coin, the coin once again moves concentrically with the disc because the coin is still pressed into the resilient pad. The channel 30 is preferably designed so that the minimum distance between the inner and middle walls is about the same as the diameter of the smallest coin that is thick enough to be pressed into the resilient pad in the channel region between the inner and middle walls. Consequently, when such a coin reaches the point where that distance is a minimum, the outer edge of the coin is adjacent the middle wall. The radius of the middle wall 32 remains constant at the desired gaging radius $R_g$ from that point to the end of the channel 30, and thus the small, thick coins exit the channel 30 with the outer edges of the coins at the gaging radius $R_g$.

Because the middle wall 32 is tapered (preferably at an angle of less than 45° from vertical), slight variations in the diameter of the small, thick coins merely cause the outer edges of such coins to be positioned at various elevations on that taper, or even slightly inwardly of the taper. At the outermost end of the channel 30, where the middle and outer walls merge, the wall engaging the outer edges of the coins becomes vertical at the innermost radius of the tapered portion of the middle wall. Thus, the outer edges of all the coins are ultimately aligned at the same gaging radius $R_g$.

Thick coins which have a diameter greater that the minimum distance between the inner and middle walls 31 and 32 follow the path as the small thick coins, except that the outer portion of a thick coin guided by the inner wall 32 gradually rides down and under the tapered middle wall 32. Any coin which extends outwardly beyond the middle wall 32 will ultimately engage the outer wall 33 because the radius of the outer wall is progressively reduced toward the outlet end of the spiral channel 30 and finally merges with the constant-radius portion of the middle wall. Consequently, these large thick coins also emerge from the spiral channel 30 with their outer edges aligned at the gaging radius $R_g$.

Thin coins which have a diameter greater than the minimum distance between the inner and middle walls 31 and 32 follow the middle wall 32 until the inner edges of the coins come into engagement with the inner wall 31, which gradually forces the outer portions of the coins under the tapered middle wall 32. As the inner wall 31 drops away from the inner edges of such coins, the outer edges of the coins ride upwardly over the tapered middle wall 32 and are then guided by the uppermost edge of the middle wall to the outlet of the spiral channel 3O.

It can occur that correctly aligned coins passing under the recycling channel 51 can be slightly shifted in their radial position. To correct this, coins which pass the recycling channel 51 enter the gaging channel 40 which allows the coins to be realigned against the radially outer wall 41. The channel 40 and wall 41 allow the coins in the sorting path an opportunity to realign their outer edges at the radial position required for correct sorting.

In order to accommodate a wide range of coin sizes, the inlet end of the gaging channel 40 has a relatively shallow depth to minimize the bouncing of thin coins, and then a deeper central region 43 which enables the thickest coins to move outwardly to the outer wall 41. FIGS. 3–7 illustrate the movement of a thin coin through these two different regions of the gaging channel 40. It can be seen that there is only a small clearance between the top surface of the thin coin and the shallow region 42 of the gaging channel, so that the thin coins are quickly brought under control within this region of the channel. The thin coins quickly move out to the outer wall 41 of the gaging channel and then follow that wall until they exit from the channel. FIGS. 8–12 illustrate the movement of a thick coin through the gaging channel. It can be seen that the thick coin is pressed into the resilient pad in the shallow region 42 of the channel, and thus the thick coins can not move to the outer wall 41 within this shallow region. As soon as the thick coins enter the deeper central region 43, however, the coins immediately move out against the outer wall 41 and then follow that wall until they exit from the gaging channel.

Beyond the gaging channel 40, the sorting head 12 forms a series of exit channels 60, 61, 62, 63, 64, 65, 66 and 67 which function as selecting means to discharge coins of different denominations at different circumferential locations around the periphery of the sorting head. Thus, the channels 60–67 are spaced circumferentially around the outer periphery of the sorting head 12, with the innermost edges of successive channels located progressively farther away from the common radial location of the outer edges of all coins for receiving and ejecting coins in order of increasing diameter. In the particular embodiment illustrated, the eight channels 60–67 are positioned and dimensioned to successively eject the eight Australian coins, namely, the 1-cent coins (channel 60), 5-cent coins (channel 61), 2-dollar coins (channel 62), 2-cent coins (channel 63), 10-cent coins (channel 64), 1-dollar coins (channel 65), 20-cent coins (channel 66) and 50-cent coins (channel 67). The innermost edges of the exit channels 60–67 are positioned so that the inner edge of a coin of only one particular denomination can enter each channel; the coins of all other denominations reaching a given exit channel extend inwardly beyond the innermost edge of that particular channel so that those coins cannot enter the channel and, therefore, continue on to the next exit channel.

For example, the first exit channel 60 is intended to discharge only 1-cent coins, and thus the innermost edge **60*a* of this channel is located at a radius that is spaced inwardly from the radius of the gaging wall 41 by a distance that is only slightly greater than the diameter of a 1-cent coin. Consequently, only 1-cent coins can enter the channel 60. Because the outer edges of all denominations of coins are located at the same radial position when they leave the gaging channel 40, the inner edges of all denominations other than the 1-cent coin extend inwardly beyond the innermost edge 60*a* of the channel 60**, thereby preventing these coins from entering that particular channel.

Of the coins that reach channel 61, the inner edges of only the 5-cent coins are located close enough to the outer periphery of the sorting head 12 to enter that exit channel. The inner edges of all other denominations extend inwardly beyond the innermost edge of the channel 61 so that they remain gripped between the sorting head and the resilient pad. Consequently, such coins are rotated past the channel 61 and continue on to the next exit channel.

Similarly, only 2-dollar coins can enter the channel 62, only 2-cent coins can enter the channel 63, only 10-cent coins can enter the channel 64, only 1-dollar coins can enter the channel 65, only 20-cent coins can enter the channel 66, and only 50-cent coins can enter the channel 67.

I claim:

1. A coin sorter comprising a rotatable disc, means for rotating said disc, a stationary sorting head having a feed opening for receiving coins to be sorted, and a lower surface parallel to the upper surface of said rotatable disc and spaced slightly therefrom, the lower surface of said sorting head forming an annular recess for receiving coins passing beneath the inner edge of the sorting head, a spiral channel for guiding those coins radially outwardly in a single file as the coins are carried along the lower surface of the sorting head by the rotating disc, a gaging recess receiving said single-file coins before they reach said exit channels, the outer wall of said gaging recess being located at the desired gaging radius for the outer edges of said coins, said gaging recess having a first flat upper surface that is spaced from the upper surface of said rotatable disc by a distance that is only slightly greater than the thickness of the thinnest coin and is less than the thickness of the thickest coin, said first flat upper surface having an upstream end and a downstream end, and a second flat upper surface that is spaced from the upper surface of said rotatable disc by a distance that is greater than the thickness of the thickest coin, said second flat upper surface having an upstream end and a downstream end, said second flat upper surface being downstream of said first flat upper surface, the outer wall of said upstream end of said second flat upper surface being located at the same radius as the outer wall of the downstream end of said first flat upper surface, the inlet end of said gaging recess tapering upwardly to said first flat upper surface.

2. The coin sorter of claim 1 wherein the radial width of said gaging recess gradually increases from a width smaller than the smallest-diameter coin denomination to a width at least as large as the largest-diameter coin denomination.

* * * * *